United States Patent [19]

Porter

[11] 4,291,613

[45] Sep. 29, 1981

[54] MONITOR FOR DOUBLE SAFETY VALVES

[75] Inventor: Edward B. Porter, Pontiac, Mich.

[73] Assignee: Ross Operating Valve Company, Detroit, Mich.

[21] Appl. No.: 14,642

[22] Filed: Feb. 23, 1979

[51] Int. Cl.[3] ..... F01B 31/12; F01B 25/26

[52] U.S. Cl. ..... 92/131; 92/5 R; 92/138; 60/535

[58] Field of Search ..... 92/131, 138, 5 R; 60/524, 525, 561; 91/1

[56] References Cited

U.S. PATENT DOCUMENTS

| | | | |
|---|---|---|---|
| 2,324,750 | 7/1943 | Wiedmann | 92/131 |
| 2,491,087 | 12/1949 | Cordwell et al. | 91/131 |
| 2,527,727 | 10/1950 | Hobbs | 92/131 |
| 2,529,393 | 11/1950 | Hogue | 92/131 |
| 3,606,486 | 9/1971 | Doerfler | 60/535 |
| 3,606,487 | 9/1971 | Kersting | 60/535 |
| 3,708,211 | 1/1973 | Bueler | 60/535 |
| 3,799,202 | 3/1974 | McAvoy | 92/131 |

*Primary Examiner*—Paul E. Maslousky

*Attorney, Agent, or Firm*—Harness, Dickey & Pierce

[57] ABSTRACT

An improved electro-pneumatic monitor for double safety valves controlled by solenoid-operated pilot valves. The monitor comprises a relatively short spool centrally held by oppositely disposed captive springs. The sensing passages are provided with relatively small orifices which help to de-sensitize the monitor. The resulting construction is resistant to shifting in response to minor double valve irregularities which otherwise could create undesired lockout conditions.

7 Claims, 3 Drawing Figures

MONITOR FOR DOUBLE SAFETY VALVES

BACKGROUND OF THE INVENTION

1. Field of the Invention

This invention relates to double safety valves of the type used in connection with machines such as presses, in which it is desired to disenable the machine should the pneumatic control system exhibit faulty behavior. The invention is particularly concerned with the construction of a monitor which senses discrepant pressure conditions between the two sides of the double safety valve and, in response to such a condition, disenables the supply circuitry to the solenoids which control the pilot valves.

2. Description of the Prior Art

It is known to provide double safety valves with an electro-pneumatic monitor in the form of a centered spool which shifts to operate an electrical lockout switch in response to discrepant pressures between the two valves. An example of this known monitor is shown on drawing 968C93 of the assignee of the present application. This prior art monitor has a relatively large spool engaged on opposite sides by centering springs. Restrictions in the housing passages leading from the sensing ports to the end chambers of the monitor were of some assistance in de-sensitizing the spool for minor pressure fluctuations. Although the prior construction provided acceptable and dependable service when the double valves operated at the most generally used supply pressure in the area of 60 PSI, undue sensitivity was sometimes exhibited where operating pressures were used which were relatively high. This could cause lockout of the monitor for minor main valve irregularities which would otherwise be considered normal. This type of lockout is called a "nuisance lockout."

One particular feature of the present invention, captive springs at opposite ends of the monitor spool, are in themselves known for a monitor spool of the type which controls the supply of fluid pressure rather than the electrical supply to the solenoids. This is shown for example in assignee's Drawing No. 309C90.

BRIEF SUMMARY OF THE INVENTION

It is an object of the present invention to overcome the above described disadvantages of the previously known electro-pnuematic monitor spools, and to provide a monitor spool assembly which will not overreact in response to minor pressure fluctuations and thus avoid unwanted lockout conditions.

It is a further object to provide an improved monitor spool assembly of this nature which is economical to construct, reliable in use and is adapted for use without the necessity of replacing or reconstructing existing housings utilizing a prior art type of monitor spool.

Briefly, the invention comprises an elongated housing having sensing inlet ports, a double ended piston slidably mounted in said housing, said piston being relatively short and forming opposite sensing chambers, a shaft extending centrally through said housing from one end to the other and passing through said spool, end plugs within said housing supporting the opposite ends of said shaft, restricted passages in said end plugs leading from the sensing inlet ports in said housing to said sensing chambers, a pair of helical coil compression springs disposed between said end plugs and said spool, and means capturing the inner ends of said springs whereby said spool when moved in either direction to compress one of said springs will not be followed by the other spring.

DESCRIPTION OF THE PREFERRED EMBODIMENT

Figure 1:
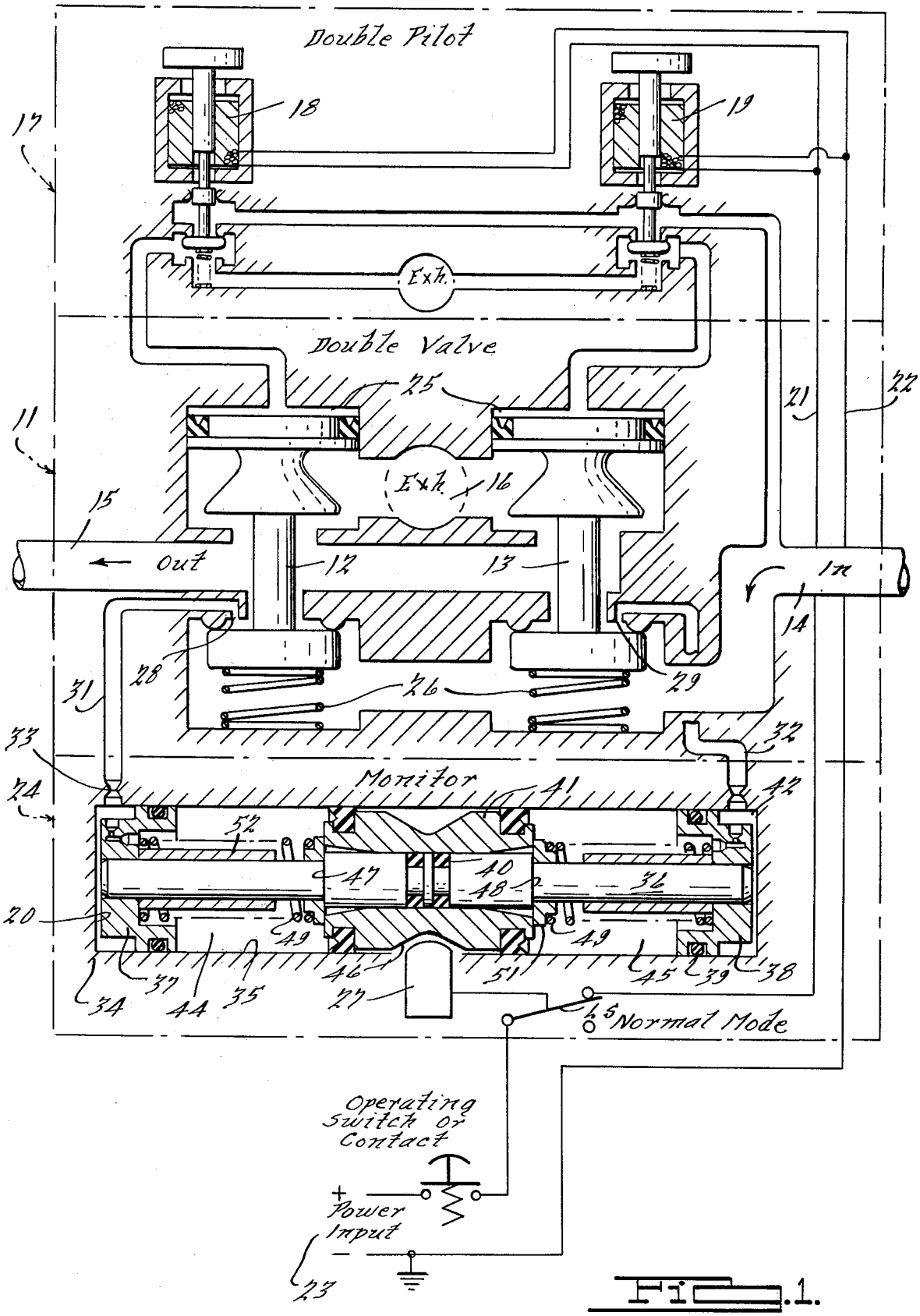
FIG. 1 is a schematic view showing a double safety valve with the novel monitor spool assembly of this invention connected thereto.

A double safety valve of a conventional type is generally indicated at 11 in FIG. 1. This safety valve, for example of which if found in DiTirro U.S. Pat. No. 2,906,246, has a pair of main valves 12 and 13 which control pressurized fluid flow from an inlet port 14 to an outlet or working port 15. The flow is in parallel through the two valves, and exhaust flow from port 15 to exhaust port 16 is also in parallel.

The double main valves are controlled by double pilot valves generally indicated at 17 which are controlled by solenoids 18 and 19. The supply of electrical current for the solenoids is through conduits 21 and 22 which are supplied from a power source 23.

The monitor spool assembly is generally indicated at 24 and has as its function the control of electrical current supply to solenoids 18 and 19, so as to disenable the pilot valves in case of discrepant main valve positions. It will be noted that when the solenoids are de-energized the pilot valves shown at 17 will be in their exhaust positions, thus evacuating chambers 25 of the two main valves, and permitting their springs 26 to move them to their closed or exhaust positions.

Figure 3:
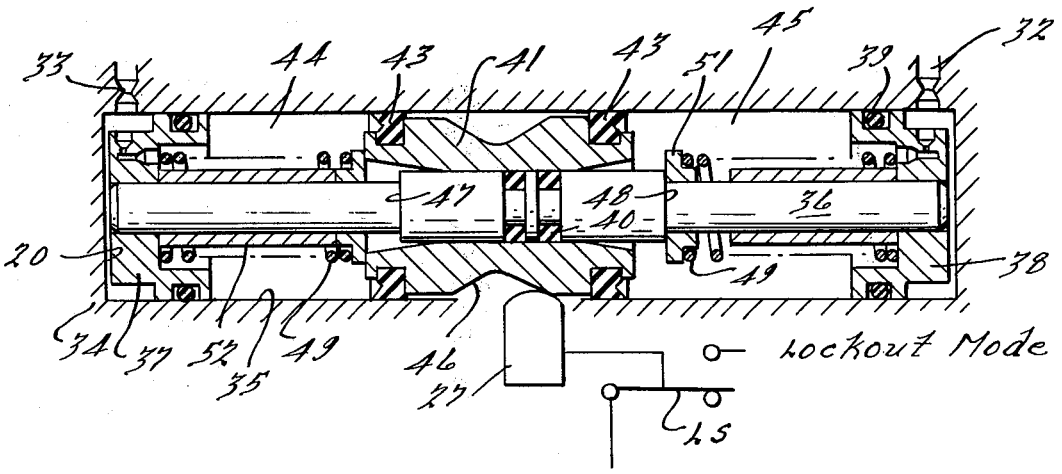
FIG. 3 is a view of the monitor spool assembly shown in its shifted position.

A lockout switch LS is provided in conduit 21 and is shiftable between a normal mode shown in FIG. 1 and lockout mode shown in FIG. 3. The shifting is controlled by monitor spool assembly 24 which, when in its normal centered position, will release the switch actuator 27. Sensing ports 28 and 29 are provided at valves 12 and 13 respectively. Passages 31 and 32 lead from these sensing ports to the housing 34 of monitor spool assembly 24. A restriction 33 is conventionally placed in the sensing inlet ports at both ends of this housing so as to de-sensitize the spool monitor assembly and inhibit its shifting to a lockout condition in response to minor pressure fluctuations.

The monitor spool lockout assembly of the present invention comprises a bore 35 in the housing which carries a shaft 36 therein. This shaft extends from one end of the bore to the other and is fixed to a pair of end plugs 37 and 38. The end plugs have seals 39 for the housing bore, these seals being spaced inwardly from the ends 20 of the bore. Annular spaces 42 are thus provided between the wall of the housing bore and the outer ends of the end plugs. These spaces are connected with the restricted sensing inlet port orifices 33 in housing 34.

The center of shaft 36 carries seals 40, and a spool 41 is slidably mounted on the shaft and engages this seal. This spool is relatively short compared with the bore 35 and carries a pair of end seals. The spool thus forms two sensing chambers 44 and 45 in the housing bore. A central recess 46 on the spool is opposite actuator 27 when the spool is in its normal centered position as shown on FIG. 1. However, when the spool shifts towards FIG. 3 position it will move actuator 27 to thereby shift switch LS to its open or lockout mode and disenable the solenoids 18 and 19. This will permit the pilot valves and thus the main valves to move to their closed or exhaust position. Switch LS will remain in its lockout position until actuator 27 is manually reset, even though spool 41 returns to its centered position when the pressures in chambers 44 and 45 are equalized.

The central portion of shaft 36 is enlarged to provide oppositely facing shoulders 47 and 48. A pair of helical coil compression springs 49 are disposed on shaft 36 on opposite sides of the spool. These springs engage collars 51 which in turn engage shoulders 47 and 48, the shoulders being spaced apart the same distance as the end surfaces of the spool. It will thus be seen that in its normal position spool 41 will be held centered by the two springs. However, when the spool shifts in one direction and compresses one spring, it will not be followed by the other spring which is held captive by its corresponding shaft shoulder. Sleeves 52 are provided within springs 49 and surround shaft 36 on opposite sides of the spool. These sleeves act as stops to limit shifting of the spool in either direction when either sleeve is engaged by its corresponding collar 51.

Figure 2:
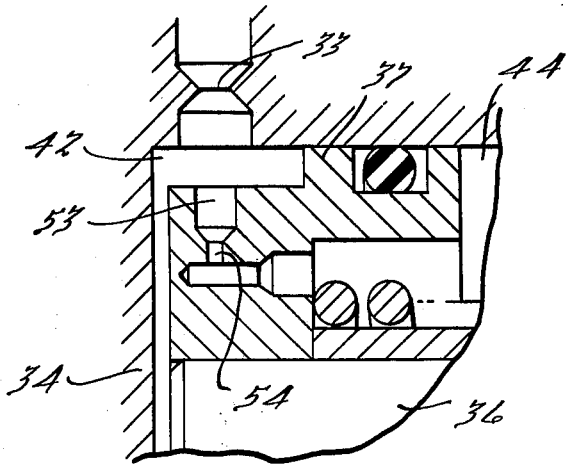
FIG. 2 is an enlarged cross-sectional view of a portion of one end plug shown the restricted orifice.

FIG. 2 shows a passage 53 in end plug 37 (plug 38 has a similar passage) which leads from chamber 42 radially and then axially to chamber 44 or 45. This passage has a restriction 54 which is preferably narrower than restriction 33. For example, if restriction 33 is 0.040 inches, restriction 54 could be 0.020 inches. This will further de-sensitize the monitor spool assembly while still not requiring any change in the housing construction itself. Thus, housings already in use with the old type of monitor spool could still be used by replacing the spool with the new type.

In operation, spool 41 will normally be held in its centered position by springs 49. Should a momentary pressure discrepancy exist between sensing ports 28 and 29, the effect of this fluctuation on spool 41 will be minimized by the factors of construction discussed above. More particularly, restrictions 54 will tend to dampen or delay pressurizing of either chamber 44 or 45. Secondly, these chambers being relatively large because of the small size of the spool, will tend to take more time to become fully pressurized. Thirdly, because of the captive nature of the springs, when the spool does shift it will not be affected adversely by the following spring which was present in the prior art construction. It was found in this known construction that the lengthening of one of the springs tended to make the spool overly sensitive to shifting.

Should a significant discrepancy between the sensing ports 28 and 29 occur, the pressure differences between the two chambers 44 and 45 will result in a shifting of the spool from the FIG. 1 to its FIG. 3 position. This will cause lockout of the system in the manner described above. It should be noted that shaft 36 will hold end plugs 37 and 38 against axial movement despite pressure flow through restricted passages 53.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. In combination, an elongated housing defining a bore, said housing having sensing inlet ports in communication with said bore at axial spaced locations, a double ended spool slidably mounted in said housing, said spool being relatively short and forming with said bore opposite sensing chambers, each of said sensing inlet ports being in communication with a respective of said sensing chambers, a shaft extending axially through said bore from one end to the other and passing through said spool, end plugs within said bore supporting the opposite ends of said shaft, restricted passages in said end plugs leading from the sensing inlet ports in said housing to said sensing chambers, a pair of helical coil compression springs disposed between said end plugs and said spool, and means capturing the inner ends of said springs whereby said spool when moved in either direction to compress one of said springs will not be followed by the end of the other spring.

2. The combination according to claim 1, said capturing means comprising a shouldered portion on said shaft centrally located with respect to said springs.

3. The combination according to claims 1 or 2, said spool having a recessed central portion engagable with a switch actuator.

4. The combination according to claims 1 or 2, said shaft being fixed to said end plugs.

5. A monitor for indicating a malfunction due to pressure variations between a pair of pressure points comprising an elongated housing, a double ended spool slidably mounted in said bore, said spool being relatively short and forming with said bore opposite sensing chambers, a pair of restricted sensing ports each communicating one of the pressure points with a respective of said sensing chambers, a shaft extending centrally through said bore and passing through said spool, end plugs within said bore supporting the opposite ends of said shaft, restricted passages in said end plugs leading from the sensing inlet ports in said housing to said sensing chambers, said restricted passages having substantially lesser effective flow area than said restricted sensing ports, a pair of helical coil compression springs disposed between said end plugs and said spool, and means capturing the inner ends of said springs whereby said spool when moved in either direction to compress one of said springs will not be followed by the end of the other spring.

6. A device for indicating a malfunction due to pressure differences between a pair of pressure points comprising an elongated housing having a uniform diameter bore therein, a double ended spool slidably mounted in said bore, said spool being relatively short relative to the length of said bore and forming with said bore opposite sensing chambers, a pair of sensing ports each communicating a respective one of the pressure points with a respective of said sensing chambers, said spool being moveable from a neutral position along said bore in response to variations in the pressure between said sensing chambers, means for providing a malfunction signal in response to movement of said spool from said neutral position, a pair of end plugs each supported in a respective opposite end of said bore, a restricted passage in each of said end plugs leading from the respective sensing inlet ports to the respective sensing chamber, the effective cross sectional area of said restricted passages being less than that of said sensing ports for damping the effect of transient pressure variations between the pressure points, and means for biasing said spool to said neutral position.

7. A device for indicating a malfunction due to pressure differences between a pair of pressure points comprising an elongated housing having an elongated uniform diameter bore formed therein, a double ended spool slidably mounted in said bore, said spool being relatively short relative to the length of said bore and forming opposite sensing chambers with said bore, a shaft extending axially through said bore from one end to the other and passing through said spool for movement of said spool along said shaft, end plugs within said bore, said end plugs having means co-acting with the respective end of said shaft for holding said shaft against transverse movement in said bore and for supporting the opposite ends of said shaft, a pair of sensing ports each communicating a respective of the pressure points with a respective of said sensing chambers, said spool being moveable from a neutral position along said bore in response to variations in the pressure between said sensing chambers, means for providing a malfunction signal in response to movement of said spool from said neutral position, and biasing spring means for biasing said spool to the neutral position.

* * * * *